US007559286B2

(12) United States Patent
Brown

(10) Patent No.: US 7,559,286 B2
(45) Date of Patent: Jul. 14, 2009

(54) SOLID FUEL COMBUSTION APPARATUS

(76) Inventor: Dave Brown, 613 Draycott Street, Coquitlam, British Columbia (CA) V3J 6M5

( * ) Notice: Subject to any disclaimer, the term of this patent is extended or adjusted under 35 U.S.C. 154(b) by 460 days.

(21) Appl. No.: 11/319,408

(22) Filed: Dec. 29, 2005

(65) Prior Publication Data

US 2007/0151491 A1 Jul. 5, 2007

(51) Int. Cl.
*F23C 1/10* (2006.01)

(52) U.S. Cl. ..... 110/261; 110/263

(58) Field of Classification Search ..... 110/261, 110/263, 265, 347, 188, 189, 187, 110
See application file for complete search history.

(56) References Cited

U.S. PATENT DOCUMENTS 4,085,976 A 4/1978 Edwards et al.
4,313,386 A 2/1982 Boldt et al.
4,345,527 A 8/1982 Marchant
4,412,814 A 11/1983 Dennis, Jr. et al.
5,010,831 A 4/1991 Halfhide

FOREIGN PATENT DOCUMENTS

WO WO 02/29324 4/2002

*Primary Examiner*—Kenneth B Rinehart
(74) *Attorney, Agent, or Firm*—Cameron IP; Norman M. Cameron

(57) ABSTRACT

There is a solid fuel combustion apparatus comprising a heated enclosure, a burner connected to the heated enclosure, and a means for providing a solid fuel from a solid fuel reservoir to the heated enclosure. The means for providing a solid fuel aspirates the solid fuel into the heated enclosure by creating a vacuum at a location in the heated enclosure. The vacuum establishes a pressure differential between the location in the heated enclosure and the solid fuel reservoir, which thereby aspirates the solid fuel from the reservoir to the heated enclosure where it is combusted by a flame from the burner.

9 Claims, 2 Drawing Sheets

SOLID FUEL COMBUSTION APPARATUS

BACKGROUND OF THE INVENTION

1. Field of the Invention

This invention relates in general to solid fuel combustion apparatuses, and more particularly, to lime kilns at pulp and paper mills.

2. Description of Related Art

In U.S. Pat. No. 4,412,814, issued to Dennis et al. on Nov. 1, 1983, there is disclosed a dual purpose gas and solid fuel burner for a brick kiln. With reference to FIGS. 8, 11 and 12, the burner includes a sawdust conveying conduit (32*f*) with attached adapter (i), which is open to the atmosphere, an air conduit (32*e*) and a pipe fitting (32*d*) conjoining the sawdust conveying conduit and air conduit. An airstream is introduced into the air conduit (32*e*) and through the burner unit producing an aspirating effect in the pipe fitting (32*d*) which causes an airstream to flow into the respective adapter (i). The airstream entering the adapter (i) flows along the sawdust conveying conduit (32*f*) and thereby induces the flow of sawdust through the burner unit.

In U.S. Pat. No. 4,313,386, issued to Boldt et al. on Feb. 2, 1982, there is disclosed a system for transport of solid particulate fuel and air to the burner ejector of a kiln. The fuel particles are delivered by an adjustable fuel feeding arrangement (16) to a venturi ejector (18), which produces a negative pressure in the fuel feeding arrangement to suck the fuel particles into the venturi, and delivers them, along with air, through a supply conduit (20) to a rotary distributor (22).

In U.S. Pat. No. 4,085,976, issued to Edwards et al. on Apr. 25, 1978, there is disclosed a pulverulent material metering and delivery system. Pressurized air is provided from the header (46) to the valve (48), the conduit (50) and the hose (44) and then to the venturi nozzle (42) from which it is ejected into the lance member (52). Operation of the nozzle (42) creates a lowered pressure in the venturi housing (40) which draws air through the valves (28,30), the metering conduit (16) and the hose (36) into the housing (40). The air induced through the feed air opening (18) onto the surface of repose (17) of the coal engages the coal particles and entrains them in the air stream at the left end of the metering conduit (16).

None of the aforementioned solid fuel burner apparatuses aspirate solid fuel from a low pressure region within a kiln. Instead, the previous solid fuel burner apparatuses aspirate solid fuel from a location external to the kiln, and then, subsequently to aspirating the solid fuel, entrain the solid fuel with a moving stream of fluid into the kiln.

Additionally, none of the above solid fuel combustion apparatuses preheat the solid fuel before it is ignited within the kiln. This limits the maximum temperature the kiln can reach.

SUMMARY OF THE INVENTION

In a first aspect of the present invention, there is a solid fuel combustion apparatus comprising a heated enclosure, a burner connected to the heated enclosure, and a means for providing a solid fuel from a solid fuel reservoir to the heated enclosure. The means for providing a solid fuel aspirates the solid fuel into the heated enclosure by creating a vacuum at a location in the heated enclosure. The vacuum establishes a pressure differential between the location in the heated enclosure and the solid fuel reservoir, which thereby aspirates the solid fuel from the reservoir to the heated enclosure where it is combusted by a flame from the burner.

In a second aspect of the invention there is a solid fuel combustion apparatus comprising a heated enclosure with a wall, and a means for providing an ignition flame in the heated enclosure. There is also a first elongate tube and a second elongate tube. The first elongate tube has a first end and a second end opposite the first end. The second end of the first elongate tube extends through the wall into the heated enclosure. The first elongate tube is within and extends along the second elongate tube. The first and second elongate tubes provide a channel therebetween. There is also a means for providing solid fuel that is connected to the channel at the first end of the first elongate tube and provides solid fuel thereto. A source of pressurized fluid is connected to the first elongate tube at the first end and provides the pressurized fluid to the heated enclosure through the first elongate tube. The pressurized fluid is released into the heated enclosure thereby creating a pressure differential between the heated enclosure and the means for providing solid fuel along the channel. The pressure differential aspirates the solid fuel into the heated enclosure where it is ignited by the ignition flame.

In a third aspect of the present invention, there is a method of supplying a heated enclosure with solid fuel comprising the steps of supplying a stream of pressurized fluid into the interior of the heated enclosure thereby creating a low pressure region at a location in the heated enclosure; connecting the low pressure region to a source of solid fuel thereby creating a pressure gradient between the source of solid fuel and the low pressure region within the heated enclosure; and aspirating the solid fuel along the pressure gradient towards the inside of the heated enclosure, the solid fuel being aspirated due to the pressure gradient.

In a fourth aspect of the present invention, there is a solid fuel combustion apparatus comprising a heated enclosure, a burner connected to the heated enclosure, means for providing a solid fuel to the burner, and means for preheating the solid fuel using thermal energy from the heated enclosure.

The present invention has the advantage of aspirating a solid fuel into a heated enclosure where it is combusted by a flame. This is in contrast to prior art solid fuel combustion apparatuses which use a stream of fluid to aspirate a solid fuel into the stream of fluid thereby entraining the solid fuel into a heated enclosure. The apparatus of the present invention allows more control over the rate at which solid fuel is provided to the heated enclosure, ensuring that the solid fuel stays long enough within an ignition flame in the heated enclosure to be combusted.

Additionally, the present invention has the advantage of preheating the solid fuel, in a controlled manner, increasing the maximum temperature are which the solid fuel can burn and thereby increasing the maximum temperature of the heated enclosure. Alternatively, the efficiency of the solid fuel combustion apparatus is increased when the solid fuel is preheated since less solid fuel is required to heat the heated enclosure to a given temperature.

BRIEF DESCRIPTION OF THE DRAWINGS

The present invention will be more readily understood from the following description of preferred embodiments thereof given, by way of example, with reference to the accompanying drawings, in which.

DETAILED DESCRIPTION OF THE PREFERRED EMBODIMENTS

Figure 1:
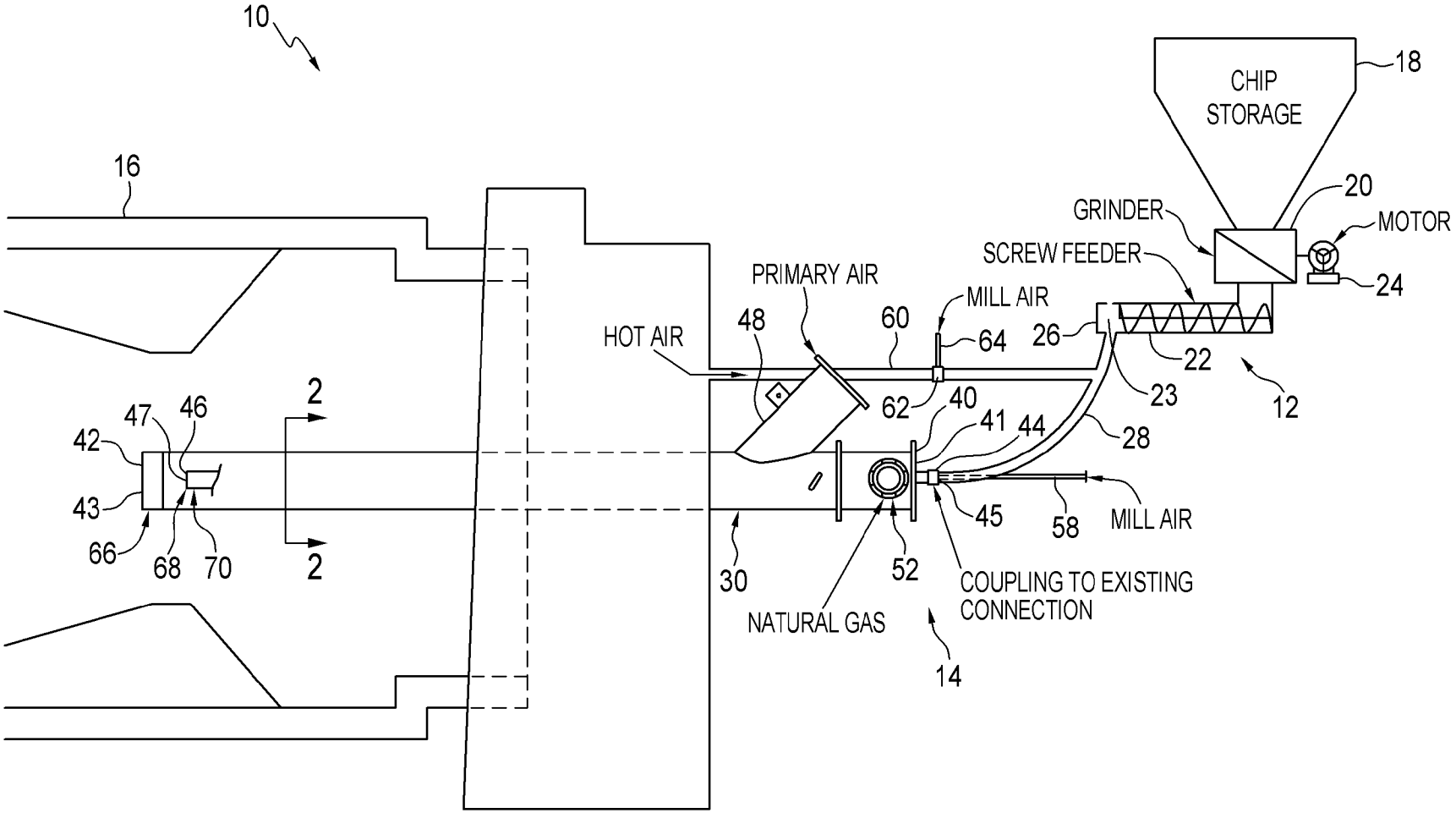
FIG. 1 is a diagrammatic of a solid fuel combustion apparatus according to one embodiment of the present invention, showing the exterior tubes of a burner partly broken away.

Referring to FIG. 1, there is a solid fuel combustion apparatus indicated generally by reference numeral 10. The solid fuel combustion apparatus 10 comprises a feeder system indicated generally by reference numeral 12, a burner indicated generally by reference numeral 14 and a heat enclosure in the form of a kiln 16. The burner 14 is a dual fuel burner, in this example, and burns an ignition fuel and a primary fuel. The ignition fuel can be, for example, natural gas and is used to provide a flame in which the primary fuel is ignited. The primary fuel can be a fluid, such as oil, or a solid fuel as in the illustrated embodiment, such as wood chips or coal.

The feeder system 12 includes a hopper 18, a grinder 20, a screw feeder 22, a conduit 28 and and a motor 24, which is a variable speed motor in this example. The hopper 18 holds the solid fuel, e.g. wood chips. The grinder 20 is located at the base of the hopper 18 and grinds the solid fuel, in this case wood chips, into a uniform consistency. The screw feeder 22 is a volumetric screw feeder. The motor 24 provides rotational energy to the grinder 20 and the screw feeder 22 so that the burner 14 is provided with a substantially constant solid fuel flow.

The screw feeder 22 conducts the solid fuel ground by the grinder 20 towards an end 26 of the screw feeder, where there is a chamber 23. The solid fuel is aspirated from chamber 23 through conduit 28 and the burner 14 along a pressure gradient into the kiln 16, as will be discussed in more detail below.

Figure 2:
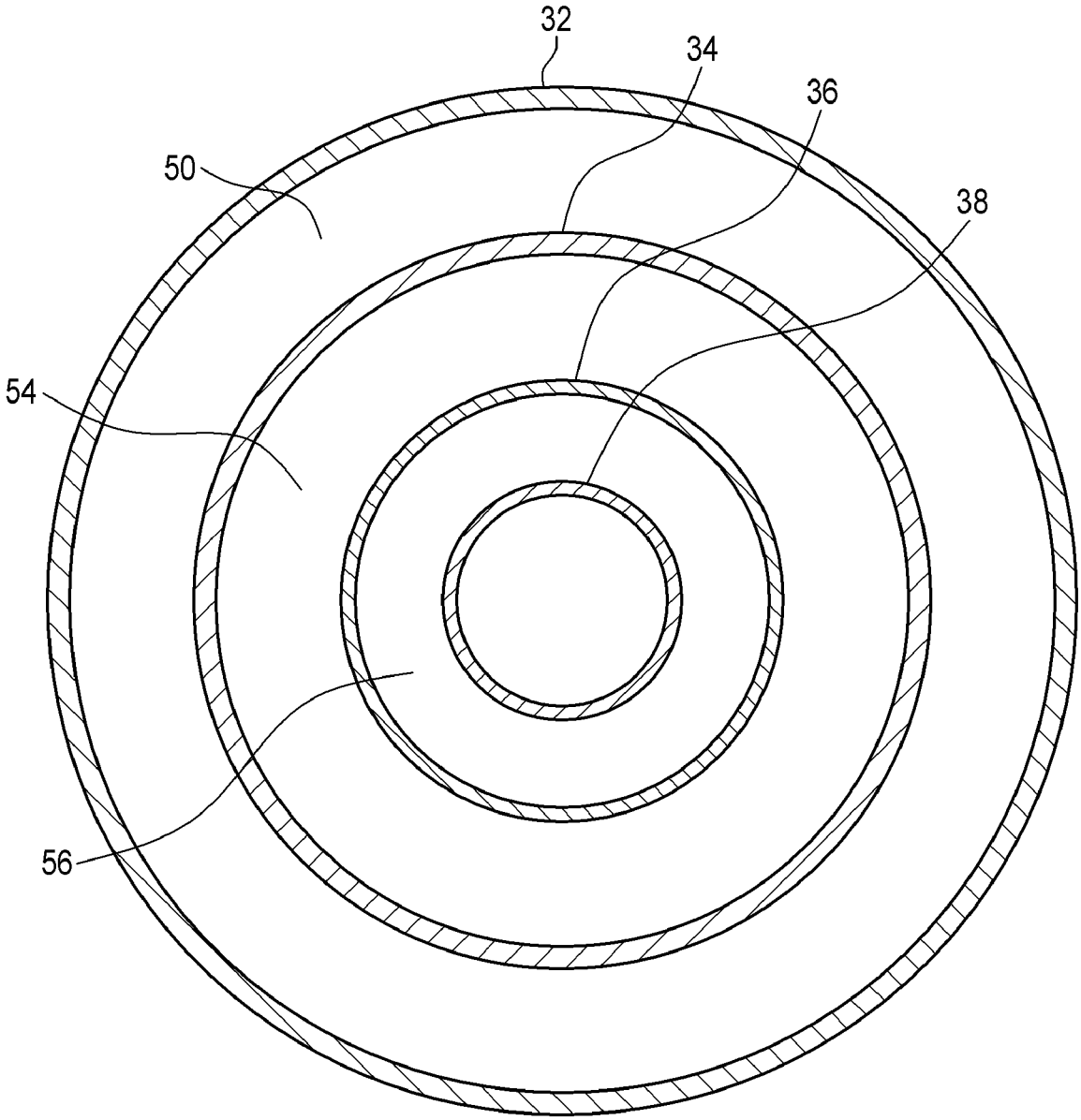
FIG. 2 is a sectional view of a burner of the solid fuel combustion apparatus taken along line 2-2 in FIG. 1.

The burner 14 includes a piping apparatus indicated generally by reference numeral 30 and conduits 58, 60 and 64. As is best seen in FIG. 2, the piping apparatus 30 comprises a first elongate tube 32, a second elongate tube 34, a third elongate tube 36 and a fourth elongate tube 38. In this example, the elongate tubes 32, 34, 36 and 38 are substantially concentric, and, in this example, the first elongate tube 32 is sixteen inches in diameter, the second elongate tube 34 is ten inches in diameter, the third elongate tube 36 is six inches in diameter and the fourth elongate tube 38 is three inches in diameter. However, these dimensions may vary in other embodiments.

The first tube 32 has opposite ends 40 and 42 and the second tube 34 is substantially coextensive therewith having opposite ends 41 and 43. The third tube 36 has opposite ends 44 and 46 and the fourth tube 38 is substantially coextensive therewith having opposite ends 45 and 47. The ends 44 and 46 of the third tube 36 and the ends 45 and 47 of the fourth tube 38 are offset from the ends 40 and 42 of the first tube 32 and the ends 41 and 43 of the third tube 34. Ends 46 and 47 are thereby retracted within tubes 32 and 34 while ends 44 and 45 of the third and fourth tubes 36 and 38 extend beyond tubes 32 and 34.

The first tube 32 has a primary air inlet 48 for providing primary air to the kiln 16 through annular channel 50 between the first and second tubes 32 and 34 of the burner 14. The first and second tubes 32 and 34 have a natural gas inlet 52 for providing natural gas to the kiln 16 through annular channel 54 between the second and third tubes 34 and 36 of the burner 14.

The fourth tube 38 functions as a carrying tube for an oil lance (not shown) when the primary fuel is oil. The oil lance is inserted through the fourth elongate tube 38 in order to provide the oil to the burner 14 and the kiln 16.

When the primary fuel is the solid fuel, the third and fourth tubes 36 and 38 form annular channel 56 for delivering the solid fuel to the kiln 16. The fourth tube 38 is also connected to a pressurized source of air via the conduit 58. The conduit 28 is connected to the annular channel 56 at ends 44 and 45 of the third and fourth tubes 36 and 38. The solid fuel travels from the chamber 23 through conduit 28 and the annular channel 56 to the kiln 16.

The conduit 60 is a hot air conduit extending between the kiln 16 and the conduit 28. The hot air conduit 60 provides hot air to the conduit 28 for preheating the solid fuel, as will be discussed in more detail below. The hot air conduit 60 has a coupling 62 connected to the conduit 64 that connects the hot air conduit 60 to a pressurized source of air.

There is a natural gas nozzle 66 between the second and third tubes 34 and 36 and near the ends 43 and 46 thereof. If the primary fuel is a solid fuel, then there is a solid fuel nozzle 68 between the third and fourth tubes 36 and 38 and near ends 46 and 47 thereof. If the primary fuel is oil, then there is an oil nozzle 70 near end 47 of the fourth tube 38.

The operation of the solid fuel combustion apparatus 10 is now discussed using a solid fuel, i.e. wood chips, as the primary fuel. In operation, natural gas under pressure is supplied to the inlet 52 and through the annular channel 54 to the natural gas nozzle 66, where it is ignited and the flame therefrom is projected into the kiln 16.

The primary air inlet 48 provides air through the annular channel 50 to the kiln 16 in order to shape the natural gas flame. The primary air can be modulated between a lower and an upper threshold of the stoichiometric air required for combustion of the ignition fuel, i.e. the natural gas, and the primary fuel, i.e. the wood chips. The stoichiometric air required can be calculated for the ignition and the primary fuel, and is controllable based on the individual firing rate per fuel with a single loop negative feedback controller.

Pressurized air is supplied to the fourth elongate tube 38 at the end 45 thereof and is delivered to the kiln at the opposite end 47. The flow of pressurized air at the end 47 of the fourth tube 38 creates a low pressure region, i.e. a vacuum, in that vicinity which establishes a pressure differential between the kiln 16 and the chamber 23 through the annular channel 56 between the third and fourth tubes 36 and 38 and the through the conduit 28.

The vacuum and the pressure differential aspirates the ground solid fuel in chamber 23 through the conduit 28 and into the annular channel 56 and then into the nozzle 68 where it is directed into the kiln at the center of the natural gas flame where it is combusted.

The pressurized air through the fourth elongate tube 38 is regulated in order to create a controllable pressure differential between the kiln 16 and the chamber 23 through the annular channel 56 so that the correct amount of solid fuel, i.e. ground wood chips, at the right velocity is delivered to the kiln 16 to ensure the solid fuel particles stay within the natural gas flame envelope long enough to be fully combusted.

Once the air inside the kiln 16 is heated, a portion of the hot air from the kiln is delivered to the conduit 28 by the conduit 60. The hot air in the conduit 60 is pressurized by the pressurized source of air through the conduit 64 at the coupling 62.

The hot air delivered to the conduit 28 preheats the solid fuel before it is delivered to the solid fuel nozzle 68 and ultimately to the natural gas flame. Each particular type of solid fuel has a specific maximum preheat temperature. The temperature to which the solid fuel is preheated can be controlled by a valve regulating the pressurized hot air, a thermocouple and a single loop negative feedback controller.

As will be apparent to those skilled in the art, various modifications to the above described embodiments may be made within the scope of the appended claims.

What is claimed is:

1. A solid fuel combustion apparatus comprising:

a heated enclosure;

a first elongate tube having a first end and a second end opposite the first end, said second end of the first elongate tube extending into the heated enclosure;

a second elongate tube, the first elongate tube being within the second elongate tube, the first and second elongate tubes providing a first channel therebetween;

means for providing solid fuel being connected to the first channel at the first end of the first elongate tube and providing solid fuel thereto;

means for providing an ignition flame in the heated enclosure including a third elongate tube, a fourth elongate tube and an ignition fuel source, said first and second elongate tubes being within the third elongate tube, said third elongate tube being within the fourth elongate tube, said second and third elongate tubes providing a second channel therebetweeen and said third and fourth elongate tubes providing a third channel therebetween, the ignition fuel source being connected to the second channel near the first end of the first elongate tube, the fourth elongate tube having an air inlet near the first end of the first elongate tube; and a source of pressurized fluid being connected to the first elongate tube at the first end and providing the pressurized fluid to the heated enclosure, whereby the pressurized fluid is released into the heated enclosure thereby creating a pressure differential between the heated enclosure and the solid fuel feeder means along the first channel, said pressure differential aspirating the solid fuel into the heated enclosure where it is ignited by the ignition flame.

2. The solid fuel combustion as claimed in claim 1, wherein the means for providing solid fuel comprises a conduit being connected to the first channel at the first end of the first elongate tube, said conduit conducting the solid fuel into the first channel.

3. The solid fuel combustion as claimed in claim 2, wherein the solid fuel combustion apparatus further comprises a third elongate tube extending between the heated enclosure and the conduit, whereby hot air from the heated enclosure is conducted through the third elongate tube into the conduit where it preheats the solid fuel.

4. The solid fuel combustion apparatus as claimed in claim 3, wherein the third conduit includes a connection to the source of pressurized fluid.

5. The solid fuel combustion apparatus as claimed in claim 2, wherein the means for providing solid fuel further comprises a hopper, a grinder and a screw feeder, the screw feeder being connected at one end to the conduit and an end opposite the one end to the grinder, the grinder being between the hopper and the screw feeder, the hopper holding and dispensing the solid fuel to the grinder, the grinder grinding the solid fuel into a substantially uniform consistency and the screw feeder conducting the solid fuel in the substantially uniform consistency to the conduit.

6. The solid fuel combustion apparatus as claimed in claim 1, wherein the first elongate tube is concentric with the second elongate tube.

7. The solid fuel burner apparatus as claimed in claim 1, wherein the first and second elongate tubes are recessed within the third and fourth elongates tubes at the second end of the first elongate tube and extend beyond the third and fourth elongate tubes at the first end of the first elongate tube.

8. The solid fuel burner apparatus as claimed in claim 1, wherein a solid fuel nozzle is attached to the first channel at the second end of the first elongate tube.

9. The solid fuel burner apparatus as claimed in claim 1, wherein a primary fuel nozzle is attached to the second channel at the second end of the first elongate tube.

* * * * *